United States Patent [19]

Tanaka et al.

[11] 4,022,169

[45] May 10, 1977

[54] CONTROL SYSTEM FOR ENGINE IGNITION TIMING

[75] Inventors: Minoru Tanaka, Chofu; Yoshio Tanaka, Tokyo; Akio Nagai, Kawagoe, all of Japan

[73] Assignee: Honda Giken Kogyo Kabushiki Kaisha, Tokyo, Japan

[22] Filed: Aug. 6, 1975

[21] Appl. No.: 602,435

[30] Foreign Application Priority Data

Aug. 9, 1974 Japan ..... 49-90746

[52] U.S. Cl. ..... 123/117 A; 123/117 R

[51] Int. Cl.[2] ..... F02P 5/02

[58] Field of Search ..... 123/117 A, 117 R, 146.5 A

[56] References Cited

UNITED STATES PATENTS

| | | | |
|---|---|---|---|
| 2,016,094 | 10/1935 | Mallory | 123/117 A |
| 3,272,191 | 9/1966 | Walker | 123/117 A |
| 3,478,729 | 11/1969 | Tada | 123/117 A |
| 3,599,614 | 8/1971 | Kittredge | 123/117 A |
| 3,793,833 | 2/1974 | Van Basshuysen | 123/117 A |
| 3,888,221 | 6/1975 | Stacey, Jr. | 123/117 A |
| 3,913,540 | 10/1975 | Hayashi | 123/117 A |

*Primary Examiner*—C. J. Husar
*Assistant Examiner*—Tony M. Argenbright
*Attorney, Agent, or Firm*—Lyon & Lyon

[57] ABSTRACT

An ignition timing control member extends through the center of a first vacuum chamber having a central movable sleeve adapted to be contacted by a flange on the control member to limit movement thereof in a direction to advance the ignition timing. The first vacuum chamber is connected to be responsive to vacuum intensity at a first vacuum outlet communicating with the engine intake passage near the throttle valve and upstream therefrom. The control member is moved by vacuum intensity within a second vacuum chamber connected through a selector valve assembly to a second vacuum outlet connected to the engine intake passage downstream from the throttle valve. An electric switch responsive to vacuum intensity in the first vacuum outlet interrupts an electrical circuit through a solenoid coil forming a part of the selector valve assembly, to cause its valve body to move from a first position connecting the second vacuum chamber to the second vacuum outlet to a second position connecting said second vacuum chamber to atmosphere.

5 Claims, 2 Drawing Figures

1
2
3
4
5
6
7
8
9
9a
10
10a
10b
11
12
13
14
15
16
17
18
19
20
21
22
23
24
25
26
27
28
29
30
31
31a
32
33
34
35
36
37

ADVANCE
RETARD
0
a
b
c
VACUUM INTENSITY

CONTROL SYSTEM FOR ENGINE IGNITION TIMING

This invention relates to internal combustion engines and particularly to engine timing control systems therefor. The invention is directed to a vacuum operated system which automatically retards the ignition timing when the engine is idling and which advances the ignition timing when the vehicle driven by the engine is cruising, the throttle valve being partly open. Unwanted pollutants in the exhaust gas are reduced and good fuel economy is maintained.

Other and more detailed objects and advantages will appear hereinafter.

Figure 1:
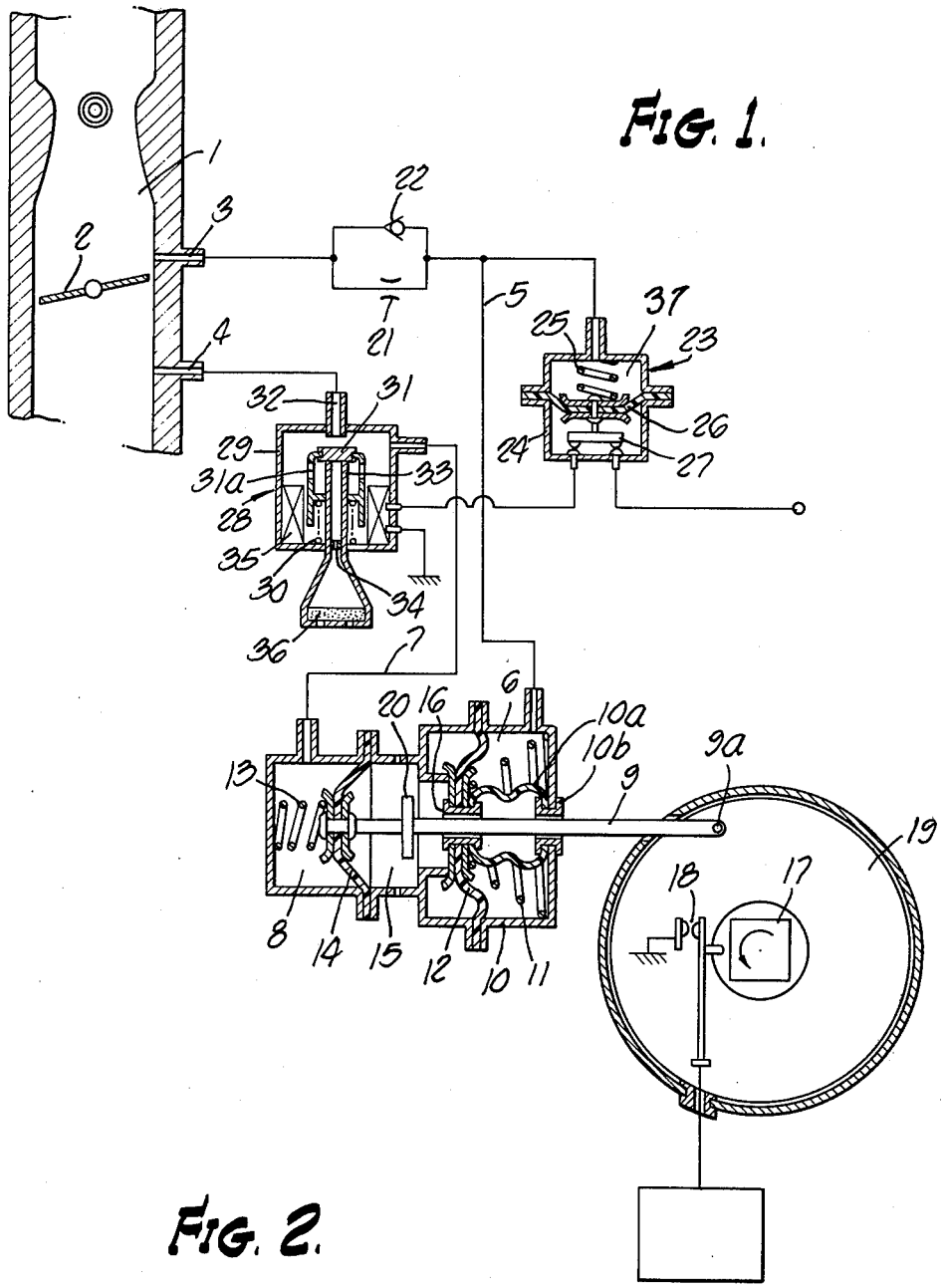
FIG. 1 is a schematic view partly in section showing a preferred embodiment of this invention.

Referring to the drawings, the engine intake passage 1 has a throttle valve 2 mounted therein. A first vaccum outlet 3 is provided in the side wall of the intake passage 1 near the throttle valve 2 and upstream therefrom. A second vaccum outlet 4 is provided in the side wall of the intake passage 1 downstream from the throttle valve 2. When the engine is idling with said throttle valve 2 nearly closed, a relatively high vaccum intensity exists at the second vacuum outlet 4, and vacuum pressure of very low intensity—practically atmospheric pressure—exists at the first vacuum outlet 3. When the vehicle is cruising, the throttle valve 2 is slightly opened so that the first vacuum outlet 3 and the second vacuum outlet 4 both reflect moderately high vacuum intensity.

Outside the intake passage 1 there is provided a first vacuum chamber 6 connected through a first passage 5 to the first vacuum outlet 3. A second vacuum chamber 8 is connected through a second passage 7 to the second vacuum outlet 4. A control member 9 in the shape of a rod is provided to control the ignition timing of the engine as a result of the combined action of the vacuum chambers 6 and 8.

More specifically, a flexible diaphragm 12 forms one wall of the vacuum chamber 6, and the compression spring 11 within the vacuum chamber 6 acts to move the diaphragm 12 to the left, as viewed in FIG. 1. The stationary case 10 contains the first vacuum chamber 6, the second vacuum chamber 8 and an air chamber 15 between them, vented to atmosphere. The control member 9 is secured to the central portion of the flexible diaphragm 14 and extends through a large opening in the movable sleeve 16 in the center of the flexible diaphragm 12, and through a flexible bellows **10*a* and then through a large opening in the stationary sleeve 10*b*. The projecting end of the control member 9 is pivoted at 9*a* to the base plate 19 which is mounted to turn about the axis of the rotary cam 17. The breaker points 18 are mounted on the base plate 19. A flange 20 is fixed on the control member 9 in a position inside the air chamber 15 and is positioned to contact the sleeve 16 at the center of the flexible diaphragm 12 to limit movement of the control member 9 toward the right as viewed in FIG. 1. Such movement of the control member 9 turns the base plate 19** in a clockwise direction to advance the spark timing.

When vacuum intensity in the second vacuum chamber 8 increases gradually to a predetermined high value, the flexible diaphragm 14 moves to the left against the action of the spring 13, thus causing the control member 9 to move the base plate 19 in a counterclockwise direction to retard the ignition timing. In this way the ignition timing is retarded along line *a* in FIG. 2 of the drawings. When the second vacuum chamber 8 is subjected to vacuum of low intensity, approaching atmospheric pressure, the flexible diaphragm 14 moves to the right under force of the spring 13 so that the control member 9 moves the base plate 19 in a clockwise direction, thereby advancing the ignition timing. This effect is shown by line *b* in FIG. 2. The amount of ignition timing advance depends upon the intensity of the vacuum in the first vacuum chamber 6; thus, when a relatively high vacuum acts in the first vacuum chamber 6, the flexible diaphragm 12 moves to the right against the action of the spring 11 to allow the flange 20 to move forward for a considerable distance until the flange 20 contacts the sleeve 16.

The first passage 5 contains an orifice 21 and a check valve 22 connected in parallel so that when vacuum intensity increases in the first vacuum outlet 3, sudden variations in the vacuum intensity will have a minimum effect in the first vacuum chamber 6. An electric switch 23 of the vacuum response type is connected to the first passage 5 downstream from the orifice 21 to operate as a detector; when a vacuum of relatively high intensity exists at the first vacuum outlet 3 for a predetermined period of time, the switch 23 opens an electrical circuit through the selector valve assembly 28. The state of cruising of the vehicle is thus detected.

The switch 23 includes a flexible diaphragm 26 acted on by a compression spring 25 within a case 24. An electrical contact member 27 moves with the flexible diaphragm 26. When the vacuum in the chamber 37 reaches a predetermined intensity, the contact member 27 is lifted to interrupt the electrical circuit through the selector valve assembly 28.

The selector valve assembly 28 is located in the second passage 7 in a manner so that the second vacuum chamber 8 may be connected either to the second vacuum outlet 4 or to atmospheric pressure through the inler filter 36. The case 29 contains a valve body 31 which is moved downward against the action of the spring 30, when the solenoid coil 35 is electrically energized. This causes the valve body 31 to move away from the vacuum inlet 32 and to close against the atmospheric inlet 33. This action connects the second vacuum outlet 4 to the second vacuum chamber 8 through the second passage 7.

When the electrical contact member 27 of the electrical switch 23 moves upward to open the electrical circuit through the solenoid coil 35, the spring 30 moves the valve body 31 away from the atmospheric inlet 33 to close against the vacuum inlet 32. Atmospheric air is them drawn inward through the filter 36 and through the restriction 34 to delay the introduction of the air to pass through the ports **31*a* and through the second passage 7 to the second vacuum chamber 8**.

Figure 2:
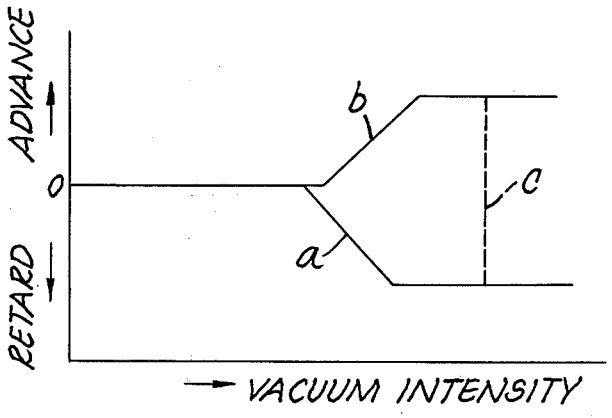
FIG. 2 is a diagram illustrating the operation of the device.

In operation, when the engine is idling with the throttle valve 2 slightly open, intake vacuum is produced primarily at the downstream side of the throttle valve 2 so that the control member 9 is retracted to retard the ignition timing along line *a* in FIG. 2, to reduce unwanted emissions in the exhaust gas. When the throttle valve 2 is opened a little wider to cause the engine to operate at a relatively low-load high-rotation condition, corresponding to cruising of the vehicle, relatively intense vacuum is developed at the first vacuum outlet 3, causing the flexible diaphragm 12 to move against the action of the spring 11, but the control member 9 nevertheless retracts by reason of the vacuum in the second vacuum chamber 8, the ignition timing being retarded as shown by the line *a* in FIG. 2.

When the cruising of the vehicle has continued for a predetermined period of time, the detector comprising the switch 23 responds after a predetermined delay to lift the contact member 27. This causes the selector valve assembly 28 to connect the second vacuum chamber 8 to atmospheric pressure. The spring 13 moves the control member 9 to advance the ignition timing. The extent of such movement of the control member 9 is determined by the position at which the flange 20 on the control member 9 comes in contact with the sleeve 16 at the center of the flexible diaphragm 12. Thus, the ignition timing moves from a point on line *a* along dotted line *c* to a point on line *b* on FIG. 2. In other words, the ignition timing is moved from retard to advance.

As described above, cruising of the vehicle is detected after a predetermined time interval and the ignition timing of the engine is automatically advanced to bring about an improvement in exhaust emissions and to improve fuel consumption. The operation is caused to occur mostly in a pressure response manner, smooth and stable.

Having fully described our invention, it is to be understood that we are not to be limited to the details herein set forth, but that our invention is of the full scope of the appended claims.

We claim:

1. In an internal combustion engine having a throttle valve positioned in an intake passage, ignition timing control apparatus comprising, in combination: a first vacuum outlet communicating with the intake passage near the throttle valve and upstream therefrom, a second vacuum outlet communicating with the intake passage downstream from the throttle valve, a first vacuum chamber having a movable element, a first passage connecting said first vacuum outlet to said first vacuum chamber, said first passage having a check valve permitting flow toward said first vacuum chamber and having orifice means in parallel with said check valve to restrict flow through said first passage in the other direction, a second vacuum chamber, means including control means for retarding the ignition timing of the engine in accordance with increase of vacuum intensity in said second vacuum chamber, a second passage connecting said second vacuum outlet to said second vacuum chamber, a selector valve assembly operatively interposed in said second passage, said selector valve assembly having a valve body movable from a first position in which said second vacuum chamber is connected to said second vacuum outlet to a second position in which said second vacuum chamber is connected to atmosphere, means responsive to increase of vacuum intensity downstream from said orifice means in said first passage for causing said valve body of said selector first position to said second position, and cooperating means on said control means engageable with said movable element of said first vacuum chamber for limiting the extent of movement of said control means in a direction to advance the ignition timing.

2. The combination set forth in claim 1 in which the means for causing the valve body to move comprises a solenoid coil and an electrical switch, said solenoid coil being energized through said electrical switch responsive to vacuum intensity downstream from said orifice means in said first passage.

3. In an internal combustion engine having a throttle valve positioned in an intake passage, ignition timing control apparatus comprising, in combination: a first vacuum outlet communicating with the intake passage near the throttle valve and upstream therefrom, a second vacuum outlet communicating with the intake passage downstream from the throttle valve, a first vacuum chamber having a movable element, a first passage connecting said first vacuum outlet to said first vacuum chamber, said first passage having a check valve permitting flow toward said first vacuum chamber and having orifice means in parallel with said check valve to restrict flow through said first passage in the other direction, a second vacuum chamber, means including a control rod for retarding the ignition timing of the engine in accordance with increase of vacuum intensity in said second vacuum chamber, a second passage connecting said second vacuum outlet to said second vacuum chamber, a selector valve assembly operatively interposed in said second passage, said selector valve assembly having a valve body movable from a first position in which said second vacuum chamber is connected to said second vacuum outlet to a second position in which said second vacuum chamber is connected to atmosphere, said selector valve assembly having a solenoid coil, an electrical circuit for energizing said coil, means responsive to increase of vacuum intensity downstream from said orifice means in said first passage for interrupting said electrical circuit energizing said solenoid coil to cause said valve body to move from said first position to said second position, and means on said control rod engageable with said movable element of said first vacuum chamber for limiting the extent of movement of said control rod in a direction to advance the ignition timing.

4. In an internal combustion engine having a throttle valve positioned in an intake passage, ignition timing control apparatus comprising, in combination: a first vacuum outlet communicating with the intake passage near the throttle valve and upstream therefrom, a second vacuum outlet communicating with the intake passage downstream from the throttle valve, a first vacuum chamber having a first flexible diaphragm provided with a central sleeve, a first passage connecting said first vacuum outlet to said first vacuum chamber, said first passage having a check valve permitting flow toward said first vacuum chamber and having orifice means in parallel with said check valve to restrict flow through said first passage in the other direction, a second vacuum chamber having a second flexible diaphragm, means including control means for retarding the ignition timing of the engine in accordance with increase of vacuum intensity in said second vacuum chamber, said control means including a control rod fixed to the second flexible diaphram and projecting through said central sleeve, a second passage connecting said second vacuum outlet to said second vacuum chamber, a selector valve assembly operatively interposed in said second passage, said selector valve assembly having a valve body movable from a first position in which said second chamber is connected to said second vacuum outlet to a second position in which said second vacuum chamber is connected to atmosphere, said selector valve assembly having a solenoid coil, an electrical circuit for energizing said coil, a switch responsive to increase of vacuum intensity downstream from said orifice means in said frist passage for interrupting said electrical circuit energizing said solenoid coil to cause said valve body to move from said first position to said second position, and cooperating means on said control rod engageable with said central sleeve for limiting the extent of movement of said control rod in a direction to advance the ignition timing.

5. In an internal combustion engine having a throttle valve positioned in an intake passage, ignition timing control apparatus comprising, in combination: a first vacuum outlet communicating with the intake passage near the throttle valve and upstream therefrom, a second vacuum outlet communicating with the intake passage downstream from the throttle valve, a vacuum chamber, a vacuum passage connecting said second vacuum outlet to said vacuum chamber, means including control means for retarding the ignition timing of the engine in accordance with increase of vacuum intensity in said vacuum chamber, a selector valve assembly operatively interposed in said vacuum passage, said selector valve assembly having a valve body movable from a first position in which said vacuum chamber is connected to said second vacuum outlet to a second position in which said vacuum chamber is connected to atmosphere, means including a check value operatively connected to said first vacuum outlet permitting flow from said first vacuum outlet, and orifice means in parallel with said check valve to restrict flow toward said first vacuum outlet and responsive to increase of vacuum intensity downstream from said orifice means for causing said valve body of said selector valve assembly to move from said first position to said second position.

* * * * *

UNITED STATES PATENT AND TRADEMARK OFFICE

CERTIFICATE OF CORRECTION

PATENT NO. : 4,022,169

DATED : May 10, 1977

INVENTOR(S) : Minoru Tanaka et al

It is certified that error appears in the above-identified patent and that said Letters Patent are hereby corrected as shown below:

Column 2, line 56, "them" should read --then--

Column 2, line 57, "introduction" should read --induction--

Claim 1, line 61, after "selector" insert --valve assembly to move from said--

Claim 4, line 3 at top of page, "first" is mis-spelled.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*